United States Patent [19]

Scarton et al.

[11] 4,244,442

[45] Jan. 13, 1981

[54] METHOD AND APPARATUS FOR TREATING EXHAUST GASES PARTICULARLY FOR AIR-OPERATED TOOLS

[75] Inventors: Henry A. Scarton, Troy, N.Y.; Warren C. Kennedy, Pittsburgh, Pa.; Keith R. Gaylo, Syosset, N.Y.

[73] Assignee: Rensselaer Polytechnic Institute, Troy, N.Y.

[21] Appl. No.: 951,034

[22] Filed: Oct. 13, 1978

[51] Int. Cl.[3] ..... F01N 1/08

[52] U.S. Cl. ..... 181/230; 181/237; 181/243; 181/255; 181/265; 181/239

[58] Field of Search ..... 181/230, 232, 243, 255, 181/264, 267-269, 272, 275, 282, 249-252, 254, 252, 281, 265, 239; 173/DIG. 2; 138/42, 43, 46; 55/276, 441, 442

[56] References Cited

U.S. PATENT DOCUMENTS

| | | | |
|---|---|---|---|
| 2,798,569 | 7/1957 | Fisher, Jr. | 181/252 |
| 3,365,022 | 1/1968 | Barber et al. | 181/230 |
| 3,561,561 | 2/1971 | Trainor | 181/267 |
| 3,635,299 | 1/1972 | Hayes | 181/230 |
| 3,815,705 | 6/1974 | Bennett | 181/230 |
| 3,891,049 | 6/1975 | Stoezel et al. | 181/230 |
| 3,918,549 | 11/1975 | Murphy | 181/230 |
| 3,941,336 | 3/1976 | Malosh | 244/53 B |
| 4,027,740 | 6/1977 | Martin | 181/281 |
| 4,113,052 | 9/1978 | McElroy, Jr. | 181/230 |

FOREIGN PATENT DOCUMENTS 508140 6/1939 United Kingdom .

*Primary Examiner*—L. T. Hix
*Assistant Examiner*—Benjamin R. Fuller
*Attorney, Agent, or Firm*—McGlew and Tuttle

[57] ABSTRACT

A muffler construction, particularly for exhaust gases of air-operated tools, comprises, a tubular sleeve having a passage therethrough, an exhaust gas pipe connected into the sleeve and defining a restricted flow passage with the sleeve, first and second opposed cylindrical coaxial shell sections, each having a closed end wall at their respective outer ends and facing in opposite directions engaged with the exhaust gas pipe, and sidewalls spaced radially outwardly from the sleeve. The exhaust gas pipe has a gas pipe discharge and there are partition walls in the shell sections defining a first expansion chamber and at least one additional expansion chamber. A constricted flow passage is defined between the first expansion chamber and the at least one additional expansion chamber with sealing and enclosing members closing the sidewalls of the first and second shell sections so as to define the first expansion chamber and at least one additional expansion chamber within the shell sections. The exhaust gases from the discharge enter into the first expansion chamber and form a vortex therein with the gases then flowing into the restricted passage into the additional chamber wherein a second vortex is generated. A final gas discharge is defined in the wall of the second shell sections which communicates with the atmosphere.

22 Claims, 18 Drawing Figures

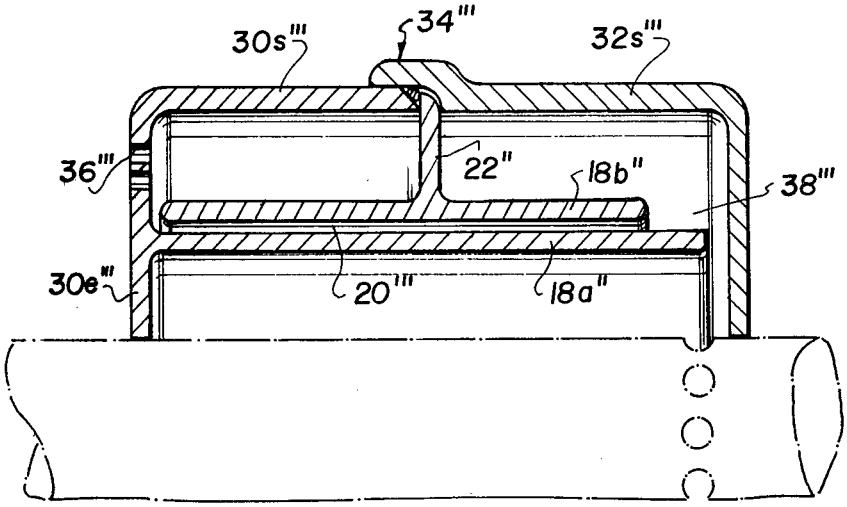
FIG. 8
FIG. 7
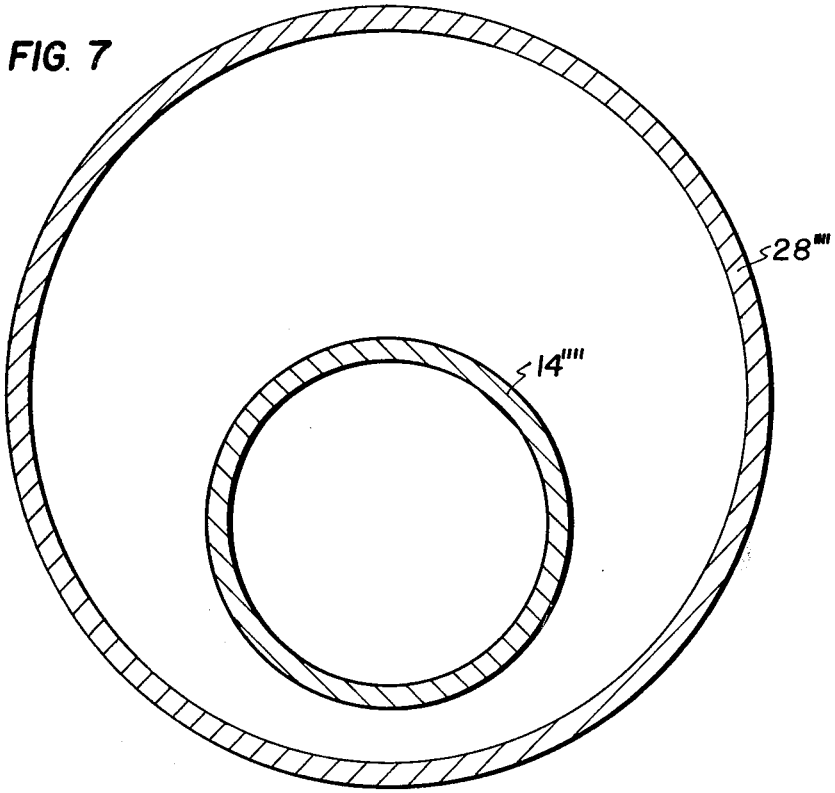

FIG. 16
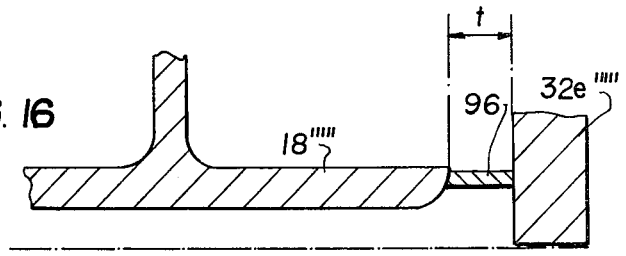
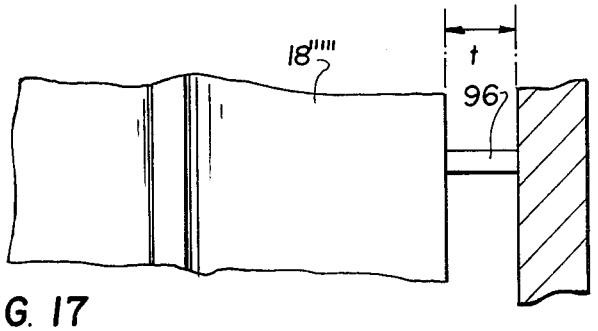
FIG. 17

METHOD AND APPARATUS FOR TREATING EXHAUST GASES PARTICULARLY FOR AIR-OPERATED TOOLS

FIELD AND BACKGROUND OF THE INVENTION

This invention relates to a device and method for treating exhaust gases and, in particular, to a new and useful muffler particularly for rotary pneumatic tools, and to a method of treating exhaust gases of such tools.

DESCRIPTION OF THE PRIOR ART

One of the problems with pneumatic tools is the high noise level which is produced by the exhaust air. This is particularly true of rotary pneumatic tools during "run-up," "run-down" and "under-load." While various efforts have been made to provide mufflers for reducing this noise level, the usual simple annular expansion chamber mufflers presently used, while reducing the noise level to some extent, do not reduce the noise level to an acceptable level.

SUMMARY OF THE INVENTION

In accordance with the invention, a novel and improved pneumatic tool muffler is provided in the form of several separable parts which can be readily assembled in embracing relation with a pneumatic tool and readily disassembled therefrom, and which, when assembled in operative relation with the exhaust ports of the body of a pneumatic tool, define at least two expansion chambers interconnected by a constricted airflow passage; a first chamber communicating with the exhaust ports of the pneumatic tool and a terminal chamber having air discharge ports to atmosphere. Thus, the air flowing from the exhaust ports of the pneumatic tool or an internal combustion engine, for example, enters the first expansion chamber and the air flows through one or more constricted flow passages to the terminal expansion chamber, the expansion chambers and the constricted passages being connected in series with each other and the terminal expansion chamber having air discharge ports communicating with the atmosphere.

The pneumatic tool muffler comprises at least two end shell sections, each including a cylindrical side wall and an annular end wall, and these shell sections are arranged in coaxial relation with each other when mounted on the pneumatic tool. One shell section has a cylindrical side wall formed with a portion to telescope over the cylindrical side wall of the other shell section, and one or more intermediate shell sections may be provided, each having a cylindrical side wall and arranged to have telescoping fits with each other and with the two end shell sections.

Most importantly, the pneumatic tool member includes a sleeved baffle member in the form of a tubular sleeve having a radially outwardly extending wall intermediate the ends of the sleeve, whose periphery is arranged to be sealingly engaged between the inter-fitting ends of two adjacent shell sections. More than one sleeved baffle may be used, depending on whether or not an intermediate shell section or two or more intermediate shell sections are interposed between the two end shell sections.

The tubular sleeve portion of the baffle member projecting into one end shell section terminates short of the end wall of this end shell section to provide a passage for air to flow from the exhaust ports of the pneumatic tool into the first expansion chamber defined by the one end shell section and the radial baffle of the baffle member, and then, after expansion, to flow through a constricted passage defined, in part, by the tubular sleeve of the baffle member to further expansion chambers. If only two end shell sections and one baffle member are provided, the opposite end of the tubular sleeve of the baffle member terminates short of the end wall of the other end shell section, so that air, after passing through the constricted flow passage, can expand into the second expansion chamber and, from there, flow through the discharge ports to atmosphere.

In the event intermediate shell sections are used with the end shell sections and, thus, two or more baffle members are provided, each with a radially extending baffle, extending from a point intermediate the ends of a tubular sleeve, the tubular sleeves define, between their adjacent ends, passages leading into each intermediate expansion chamber.

By virtue of the series of expansion chambers defined by the shell sections and the associated baffle members, each including a tubular sleeve and a radially extending baffle or wall which is sealed to the junction between adjacent shell sections, the noise level of the discharged air is greatly reduced due to the necessity for the air discharged from the exhaust ports of the tool to flow before discharge into each expansion chamber in series and, between expansion chambers, to flow through constricted flow passages before being allowed to exit through the discharge ports of the terminal end shell section.

Accordingly, an object of the present invention is to provide an improved muffler, particularly for treating gases which are directed out of air-operated tools, which comprises, a tubular sleeve having a passage therethrough which is adapted to be arranged over an exhaust gas pipe from an air-operated tool so that it defines a constricted flow space with the pipe, which includes first and second opposed cylindrical coaxial shell sections, each of which has an outer closed end wall which engages over the pipe and one of which is spaced from the tubular sleeve so that exhaust gases issuing from the exhaust pipe flow into a first expansion chamber which is formed radially around the sleeve between the sleeve and an end wall of the cylindrical shell section and, wherein, the space surrounding the sleeve radially inwardly of the shell sections or any cylindrical extensions defined between the shell sections is closed axially by a radially extending wall portion of the tubular sleeve so that at least one first expansion chamber is formed for the inflow of the exhaust gases into a vortex flow therein which communicates through the constricted flow space with at least one additional expansion chamber in which another vortex flow of the gases takes place and which also includes a discharge port in one of the end walls of the shell section for the discharge of the gases after they flow through the vortices and the constricted flow passage into the atmosphere.

A further object of the invention is to provide a method of treating exhaust gases, such as gases from air-operated tools, which comprises, directing the gases into a first expansion chamber in a manner to cause them to flow in a vortex, permitting the escape of the gases and the flow-out of the expansion chamber through a constricted flow passage, directing at least some of the escape gases from the constricted flow passage into at least one additional expansion chamber to cause them to flow in at least one additional vortex, and permitting the additional vortex gases to escape to the constricted flow passage, and discharging a portion of the escape gases in the constricted passage to atmosphere.

A further object of the invention is to provide a muffler which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 7 is a sectional view through the device indicating another embodiment in which the muffler is offset from the exhaust pipe;

FIG. 8 is a partial sectional view of another embodiment of the invention;

FIG. 16 is a partial view similar to FIG. 12 on an enlarged scale indicating the means for adjusting the position of the tubular sleeve; and FIG. 17 is a top plan view of the embodiment shown in FIG. 16.

DESCRIPTION OF THE PREFERRED EMBODIMENTS

Figure 1:
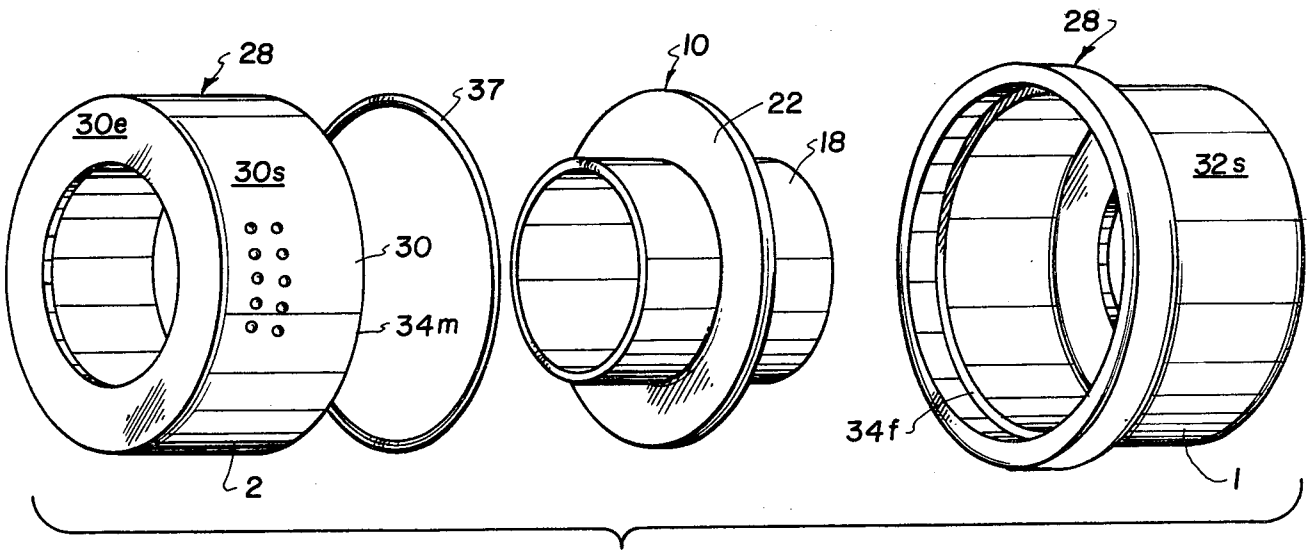
FIG. 1 is an exploded perspective view of a muffler for an air tool, constructed in accordance with the invention.
Figure 2A:
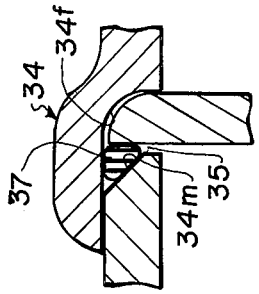
FIG. 2*a* is an enlarged detail showing the interconnection of the shell sections of the muffler.
Figure 2:
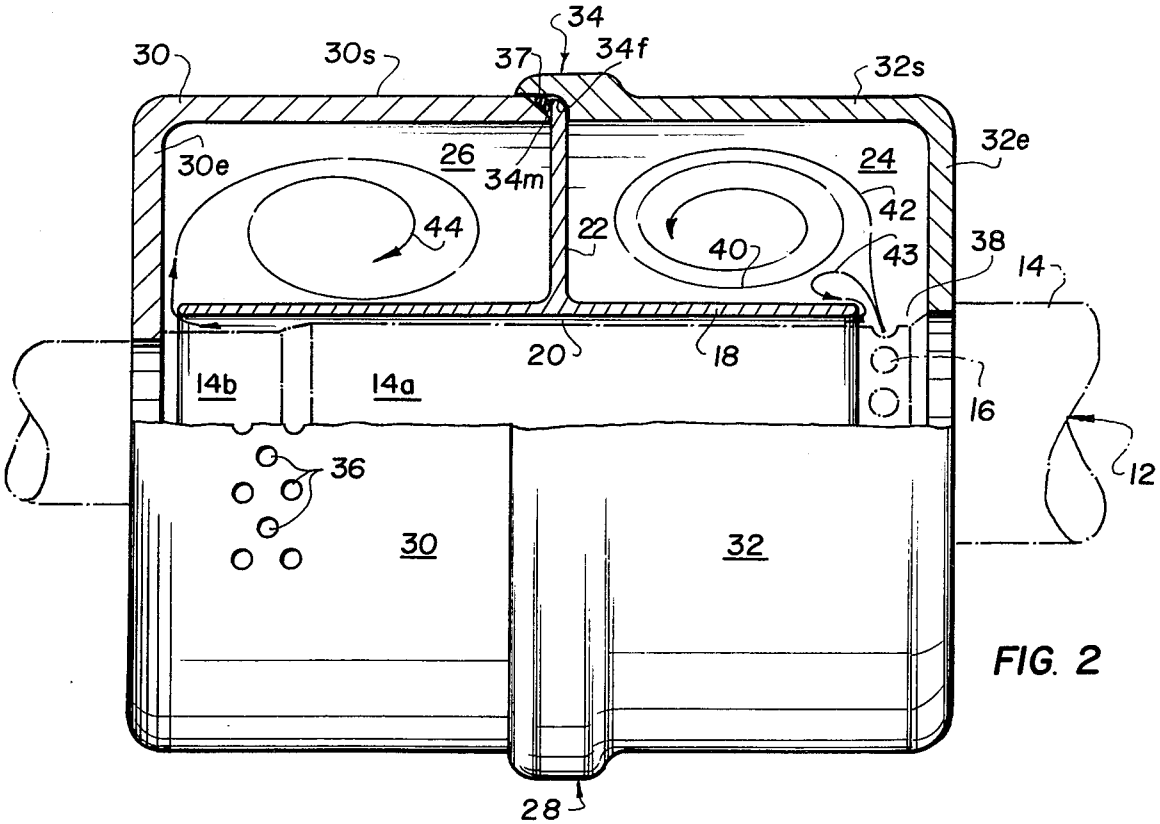
FIG. 2 is a partial elevational and partial sectional view of the muffler shown in FIG. 1 engaged on an air tool.

Referring to the drawings in particular, the invention embodied therein as shown in FIGS. 1, 2 and 2*a*, comprises, a muffler, generally designated 10, for use primarily with air-operated tools having a tool casing 12 with an exhaust pipe 14, which includes an exhaust pipe discharge 16.

In accordance with the invention, muffler 10 comprises an inner tubular sleeve 18 which is spaced radially outwardly from the walls of the exhaust pipe 14 so as to define a constricted flow space 20 therebetween. The tubular sleeve 18 is provied with a radially outwardly extending wall 22 which forms a partition between a first expansion chamber 24 on one side of the wall and a second expansion chamber 26 on the opposite side of the wall and within a cylinder or housing 28 which is engaged over the exhaust pipe 14.

The exhaust pipe 14 includes a large diameter portion 14*a* and a small diameter portion 14*b*. The constricted flow space or passage 20 between sleeve 18 and the large diameter portion 14*a* is smaller than that between the sleeve 18 and the small diameter portion 14*b*. In FIG. 2, final discharge ports 36 are shown which overlay the small diameter portion 14*b* of the exhaust pipe 14.

In accordance with a feature of the invention, the housing 28 is made up of a plurality of shell sections including a first cylindrical shell section 30 and, in the embodiment of FIGS. 1, 2 and 2*a*, a second cylindrical shell section 32. Each shell section includes an end wall 30*e* and 32*e* and a side wall portion 30*s* and 32*s*. The end wall portions 30*e* and 32*e* are provided with openings through which the exhaust pipe 14 extends. The construction includes sealing and enclosing means, generally designated 34 which, in the first embodiment of the invention, comprises, a sealed joint, including a female coupling portion 34*f*, formed at the inner end of the side wall 32*s* and a male coupling portion 34*m* formed at the end of a side wall 30*s*. The male and female portions 34*f* and 34*m* fit together along with the outer end of the wall 22, and a sealing ring 37 to form the sealing and enclosing means which close the respective chambers 24 and 26. A space 35 is advantageously provided for more complete sealing of the parts together, and to permit some axial adjustment of the shells 30 and 32 in respect to the tubular sleeve 18.

A final discharge for the exhaust gases which are treated, is in the form of a plurality of ports 36 which are defined in the shell portion 30 and which communicate with the second expansion chamber 26. In accordance with the method of the invention, exhaust gases, such as the gases from an air-operated tool, are directed out of the exhaust conduit for such gases, in this case, the exhaust pipe means 14, and are permitted to flow through a flow entrance 38 and move into an expansion chamber 24 so that some gases form a whirling vortex 40 in this chamber. The flow conditions are such that a portion of the gases of the vortex separate and flow in the direction of arrow 43 to the constricted flow space 20 from the first expansion chamber into the second expansion chamber 26. The gases in the vortex 40 flow circumferentially around the tube and then also enter the constricted flow space 20. Some gases exit from the discharge ports 16 and flow at once through the constricted flow space 20. In the second expansion chamber 26, the gases again assume a vortex flow 44 and they then flow around the tube and exit through the final discharge ports 36.

Figure 3:
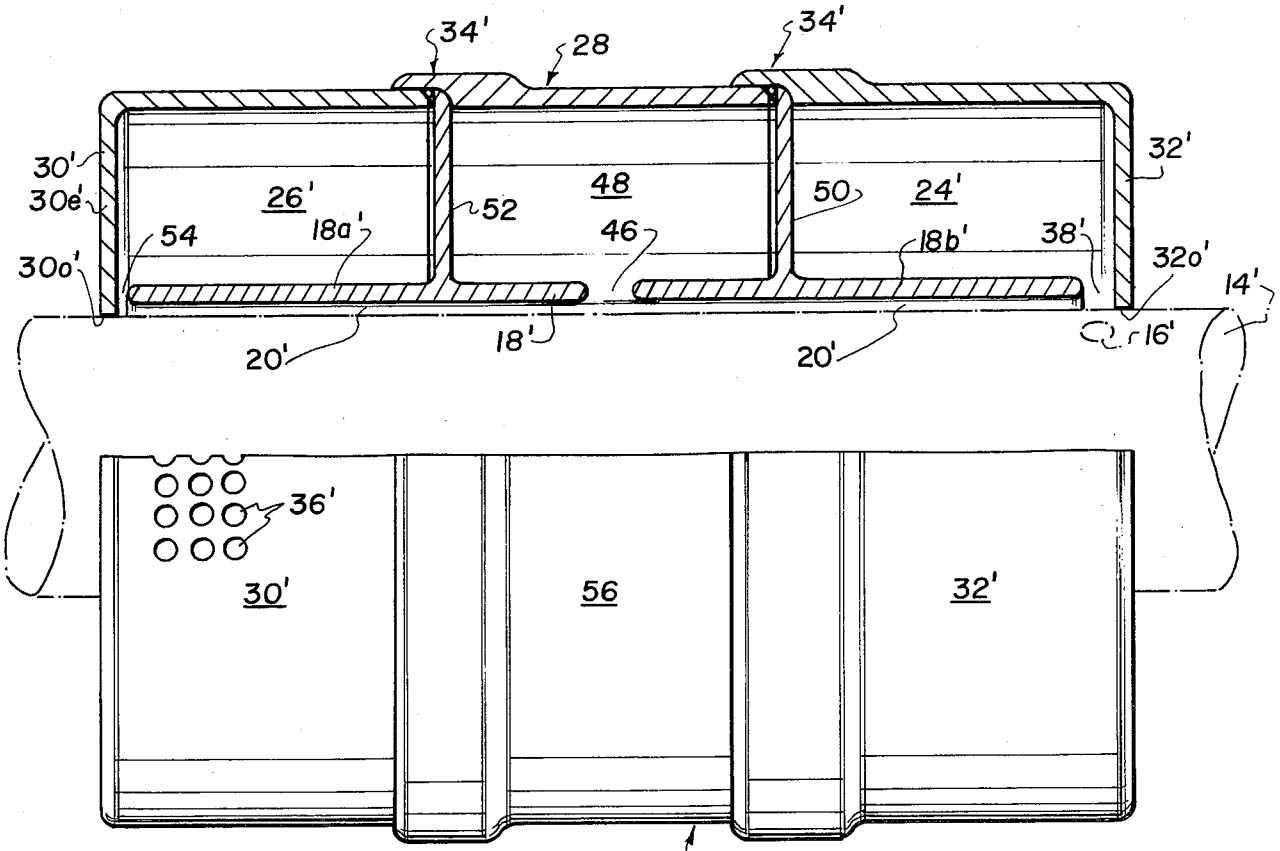
FIG. 3 is a view similar to FIg. 2 of another embodiment of the invention.

In the embodiment of FIG. 3, similar parts are designated with similar numbers, but with primes added thereto, and they include exhaust gas pipe means 14' which is again advantageously constructed so that shell parts 30' and 32' have openings 30o' and 32o' at each end, through which the exhaust pipe means 14 extend. Constricted passage means are again defined in this embodiment by exhaust pipe means 14' and a tubular sleeve 18', which is made in two sections 18a' and 18b'. In this embodiment, exhaust gases exit through the exhaust gas pipe opening 16' and flow through a flow entrance 38' into a first chamber 24', where they assume a vortex flow. The gas escaping from the vortex flow again back through the flow entrance 38' and move along a constricted flow passage 20' where a portion will exit through an opening 46 defined in an intermediate chamber 48 located between the first chamber 24' and the second chamber 26'.

Figure 4:
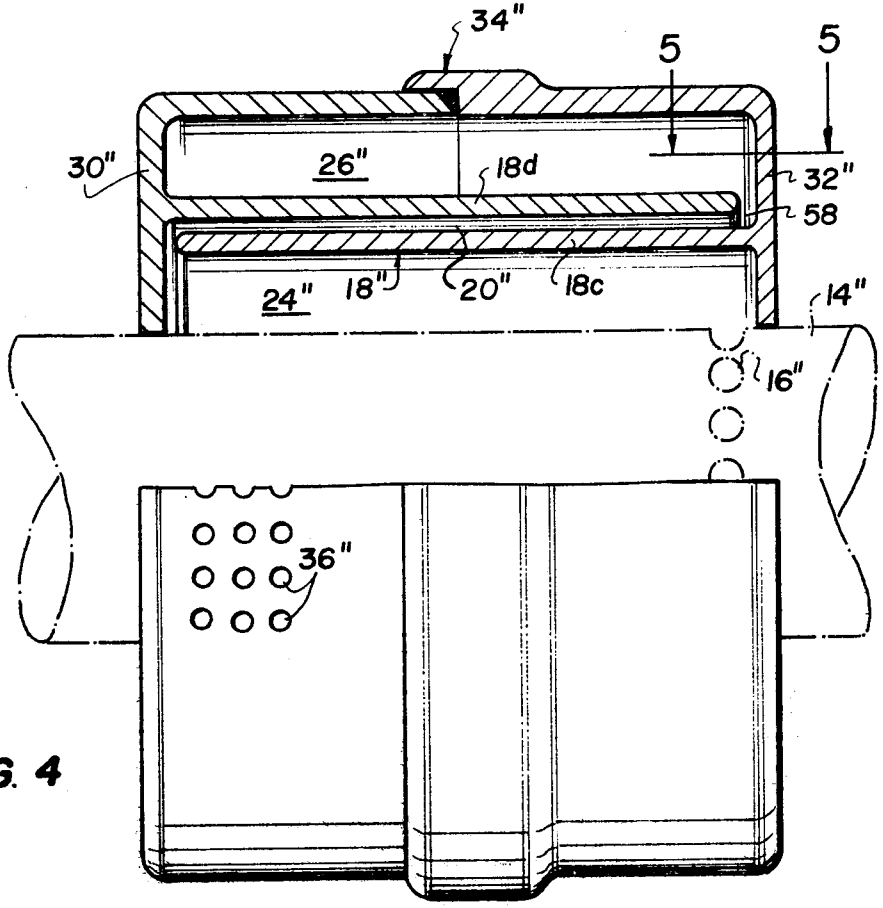
FIG. 4 is a view similar to FIG. 2 of another embodiment of the invention.
Figure 5:
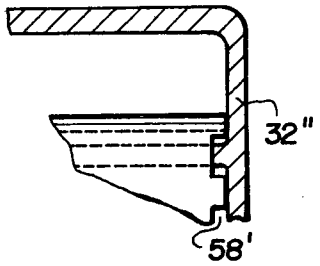
FIG. 5 is a partial section taken along the line 5–5 of FIG. 4.

In this embodiment, the sealing enclosing means 34' comprises two sealing and enclosing joints which are formed in the same manner as in the first embodiment, but which include partition walls 50 and 52 which are at spaced axial locations, instead of the single partition wall, as wall 22 in FIG. 2. The chamber 48 forms a resonating chamber to aid in noise reduction, but if flow conditions are such, a vortex will form in this chamber 48. After some of the gases escape from any vortex which may be formed in the intermediate chamber 48, it again moves along the constricted passage 20' and through an opening 54 defined between the tubular sleeve sections, 18a' and 18b', and the end wall 30e'. In this embodiment, the complete cylindrical housing 28' includes an intermediate open cylindrical housing part 56 in addition to the end cylindrical shell sections 30' and 32'. Also in this embodiment, the final housing shell section is provided with the final discharge in the form of ports 36'. A discharge to a second exhaust pipe (which has not been shown) is also possible. In the embodiment of FIGS. 4 and 5, the tubular sleeve member, generally designated 18'', comprises a first tubular sleeve part 18c affixed to a cylindrical shell section 32'' and a secnd tubular sleeve part 18d which is disposed radially inwardly of, and concentric to, the part 18c, and is carried by a cylindrical section 30''. In the embodiment of FIGS. 4 and 5, the partition wall between a first vortex chamber 24'' and a second vortex chamber 26'' is formed by the combined tubular sleeve members 18c and 18d and the constricted flow passage 20'' is also formed by the wall portions 18c and 18d. In this embodient, the sleeved portion 18d is advantageously formed with a plurality of circumferentially spaced teeth 58' which define a flow entrance into the second chamber 26''. The second chamber 26'' has a connection to the final discharge in the form of discharge ports 36''. In the construction of the embodiment of FIGS. 4 and 5, gases, such as air, which are delivered by the exhaust gas pipe means 14'', are delivered through discharge openings 16'' into the first expansion chamber 24'' where they form a vortex flow similar to the other embodiments.

Figure 6:
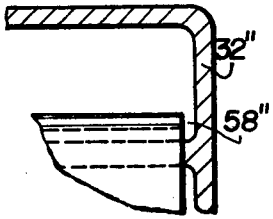
FIG. 6 is a view similar to FIG. 5 of another embodiment of the invention.

In addition, this vortex flow gas gradually moves off through the constricted passage 20'' into the additional expansion chamber 26'', from which it gradually exits through the final discharge 36''. The constricted passage 20'' communicates with the chamber 26'' through a passage 58 which may be completely annular or may comprise the intermediate rectangular passages 58' which are distributed at spaced circumferential locations around the end of the sleeve 18d, or the opening 58 may be complete annular opening 58'', as shown in FIG. 6. The sealing and enclosing means 34'' is completely analogous to the earlier seals 34 in FIG. 2.

In the embodiment of FIG. 8, a wall portion 18b' comprises a sleeve having a partition wall 22'' so that a flow passage 38'', which communicates with the constricted flowspace 20''' is formed from sleeves 18a'' and 18b''. In this embodiment, the discharge in the form of ports 36''' are located in an end wall 30e'''. The sealing and enclosing means in the embodiment of FIG. 3 includes the two partition walls 50 and 52, in addition to the intermediate cylindrical portion 56 and end cylindrical shell sections 30' and 32'. In the embodiment of FIG. 4, this sealing and enclosing means does not include a partition wall. In the embodiment of FIG. 8, the enclosure means 34''' includes partition wall 22'', plus the side wall portions 30s''' and 32s'''.

The embodiment of FIG. 7 merely indicates that the exhaust pipe means 14'''' may advantageously comprise an exhaust pipe which is eccentrically positioned with respect to a housing, generally designated 28'''', which may be made up in accordance with any of the other embodiments shown herein.

Figure 9:
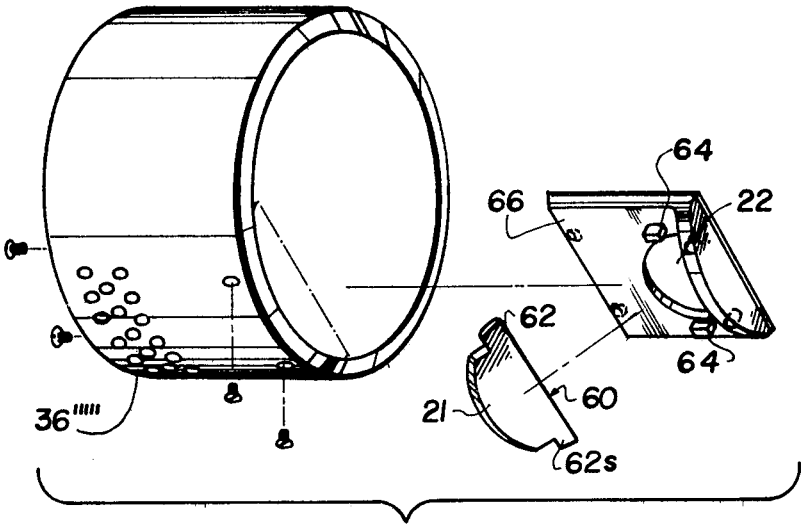
FIG. 9 is an exploded perspective view indicating an alternate embodiment for the final discharge of the gases.

FIG. 9 indicates a construction for preventing back flow of gases (which might occur with gases from a pneumatic motor when the motor is suddenly turned off), through a final discharge 36''''', which comprises a plate valve 60 having shoulders 62s on each side which engage over pivots 64 defined at spaced locations on a partition wall 66. The construction may be used, for example, in a construction similar to the embodiment of FIG. 1, by forming a chamber 68 in a shell section 30, 31, which may be made in other respects similar to the shell section 30 of FIG. 2. Flow from the chamber 26 may then be through a valve opening 70 of the wall 68 by forcing the plate valve 60 against the force of a spring 72 to permit outflow in the direction of the arrow 74, for example, through a port 36a of the final discharge. Other ports, such as the port 36b, may be closed when the flow plate is in the position shown in FIG. 10 in solid lines, but would be open when the valve member is not to this end position, such as an intermediate position thereof.

In the dotted line position of the plate 60, the opening 70 would be closed. The force of the spring 72 may therefore be chosen to provide for the desired exhaust of the treated gases in accordance with operating conditions and requirements to achieve, for example, the minimum sound of operation. Such a condition might occur when the air supply is shut off to a rapidly spinning air motor, such as to cause the air to be pumped back into the tool and to produce a large noise.

Figure 11:
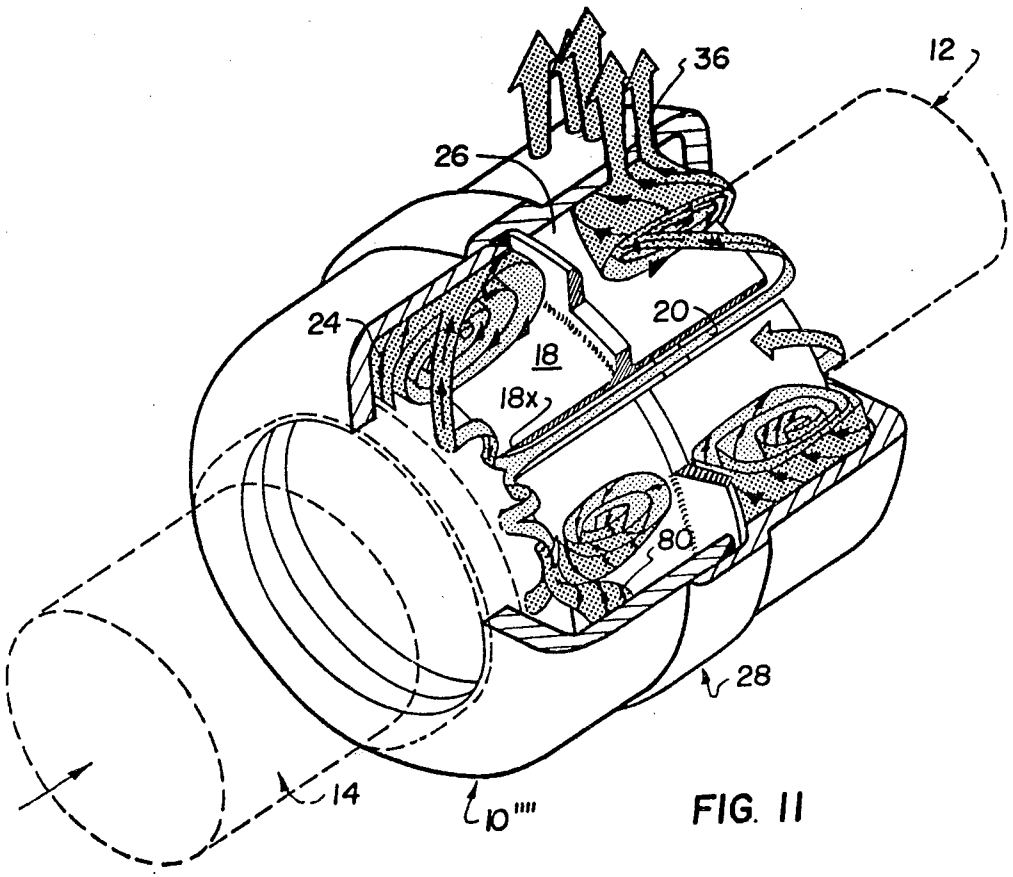
FIG. 11 is a perspective view partly in section indicating another embodiment of the invention.

FIG. 11 shows a muffler 10'''' which is similar to the muffler shown in FIG. 2, indicating the manner in which the gases will join the toroidal vortex flow in the two chambers 24 and 26 and then issue out through the final discharge 36. It is advantageous if the edge 18x of the tubular sleeve member 18 is made to a sharp point so as to control flow separation upon entry of air into the constricted flow space 20. As shown in FIG. 11, some part of the flow is likely to form a tornado-type vortex 80 upon entrance into the chamber 24.

A feature of the invention with respect to all of the embodiments is that the various shell sections which make up the whole housing may be easily disassembled for cleaning or repair, if necessary. These parts can be made by common means, such as machining, die casting, injection molding or compression molding.

The constricted passage 20 aids in insuring that the noise of the gases is reduced, especially when the device is used with an air tool during the tool run-up and run-down. The basic construction makes it possible to provide a plurality of expansion chambers, and the size of the chambers and the dimensions of the constricted passages therebetween may be varied in accordance with design requirements.

With the present invention, it is a simple matter to add one or more chambers to provide for additional sound attenuation of the eventual gases which are discharged. Large surface porous diffusers may be installed in the muffler in addition to reduce exhaust noise. Such diffusers might be made of sintered metal or tightly packed fine filaments, and they can be constructed as removable inserts which are appropriately sealed to prevent side leakages or constructed to permit easy disassembly and replacement. The shell sections may be made of any desired configuration, such as circular, cylindrical, elliptical, etc.

The muffler may be attached to one side of the tool in an eccentric manner, or it may, for example, be connected by a separate flexible or tubular connection, if so desired. The various parts which make up the housing are advantageously joined together in a manner permitting their easy disassembly as desired. The construction shown in FIG. 2, for example, can result in a muffler exterior which is cold enough for moisture condensation to occur. This may happen if a metal or similar outer container of relatively high thermal conductivity is employed. Such a problem will not occur for low thermal conductivity material, such as injection molding or molded fiber reinforced plastics. An insulating layer can be added as a coating to the existing configuration if metal is employed.

It should be appreciated that the present invention provides particular applicability with respect to a provision of a muffler for an air-operated tool, particularly, a tool in which an eccentric vane-type air driven motor is employed for driving an impact-type tool, and in which there is a sudden buildup of the exhausted air and, in some instances, the buildup of air progresses in its flow around the exhaust pipe 14 and out through the various discharge openings 16 which are arranged in an annular pattern around the circumference of the exhaust pipe 14. With such types of tools, there is a large noise which is present during the operation of the tool and this is vastly improved by the invention in the fact that the gases which are exited from the tool are acted upon so that they assume a uniform vortex flow and exit from the tool. Such a flow and exit of the exhaust gases is an improved flow over the normally occurring flows in which there is reversal turbulence and large noise. Because the flow conditions are improved and streamlined, the efficiency of the device is vastly increased and, hence, the power which can be effected from such a tool is vastly improved.

Figure 10:
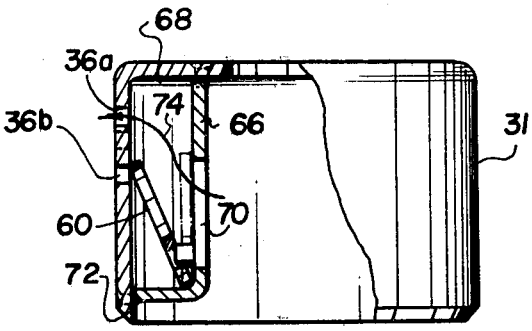
FIG. 10 is an elevational view partly in section of the device shown in FIG. 9.

In order to facilitate the control of the exhaust gases, the muffler may advantageously have a valve control, as shown in FIGS. 9 and 10, or any type of check valve to facilitate the closing off of the air flow so that, when the tool attempts to pump air back into itself, while spinning down, for example, the check valve will become effective to prevent such a condition and to prevent noise which would result therefrom. In the embodiment shown in FIG. 12, a tool, generally designated 12'''' includes an air flow in the direction of arrow 82, which exits from exhaust ports 16'''' and a part of it flows into the chamber 26 and forms a vortex 44'''' as in the other embodiment and, in addition, a part is diverted backwardly, as shown by the arrow 84 and, in doing so, it passes a sharpened corner **18*x*'''' which is similar to the corner mentioned in respect to FIG. 11**.

It has been found in the construction illustrated that the critical aspect of the design is the width of the space designated T from the tip of the sharpened corner **18*x*'''' to the side wall 30*s*''''. The pointed edge 18*x*'''' induces a flow separation at the location so that a portion indicated by the arrow 84 proceeds easily through this space or constricted passage 20''''. The sharp right angle corner 18*x*'''' induces flow separation and this flow, combined with the flow directly into the constricted passage 20'''' encourages the vortices 44'''' in chamber 26 and 45'''' in chamber 24 to form a flow in separate vortex paths which tend to attach to the walls of the interior of the shelves and they enhance any delayed fluid flow into the constricted passage 20'''' and eventually out the discharge 36''''**.

In order to obtain close control over the axial distance t in respect to passage 38'''', the closing and sealing means 34'''' and "O" ring 37'''' is fitted in the space between ends **34*f*'''' and 34*m*'''' or the partition wall 22'''' and the part 34*m*'''' which makes it possible to shift the shells 30'''' or 32'''' axially. This makes it possible to adjust the opening defined by the dimension t between the end of the sleeve member 18*e* and the guide walls 32*e*''''**.

Figure 12:
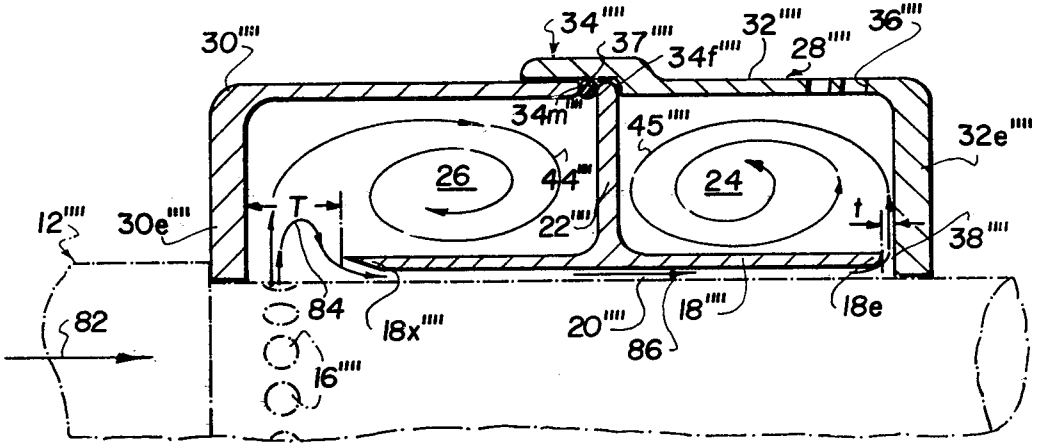
FIG. 12 is a view similar to FIG. 2, but with the exhaust pipe and shells reversed.

In the embodiment shown in FIG. 12, the "O" ring is situated to permit the shifting movement of the sleeve member 18'''' in a manner to vary the opening of the upstream gap T or the downstream gap t. The downstream gap t is formed by a wall edge **18*e* which is rounded on its underside and provided with a sharp corner at the top. The part between the rounded bottom and the top is formed radially and the construction facilitates the formation of a vortex 45'''' so that it tends to hug the wall of the chamber 24**.

The overall power loss of the tool and the pressure drop can be reduced in the design of the invention by enhancing the two vortices which flow in the chambers 24 and 26. By ordering the flow in the vortice form, there is a reduction in the size of the separated regions that would otherwise exist which may have unfavorable entrance conditions due to radial flow that may come out from the exhaust holes of the side of the device at the location 16''''. The amount of the vorticity which is formed in each of the chambers 24 and 26 is controlled by the entrance and exit conditions of the air flow.

The provision of a sharp corner at the location **18*x*''''** facilitates flow separation through the gap defined by the letter T.

The device may be used for automotive or other similar applications wherein sudden expansion and/or the flow direction changes in a short distance. Engine power can be enhanced through the reduction of losses by production of stable vortices which do not require the generation of much additional vorticity in the form of separated flow wakes. The device of the invention minimizes the convection away of vorticity in the exhaust system.

Figure 13:
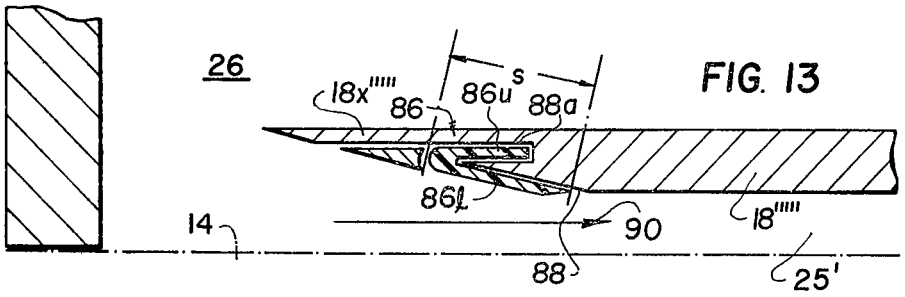
FIG. 13 is a partial view, similar to FIG. 12 on an enlarged scale, of another embodiment of the invention.
Figure 14:
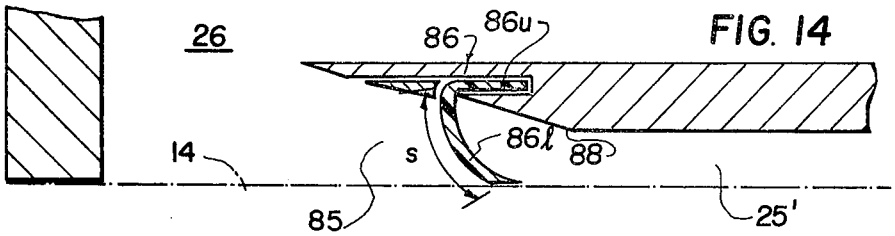
FIG. 14 is a view similar to FIG. 13 indicating the flexible valve member shown in FIG. 13 in a shutoff position.
Figure 15:
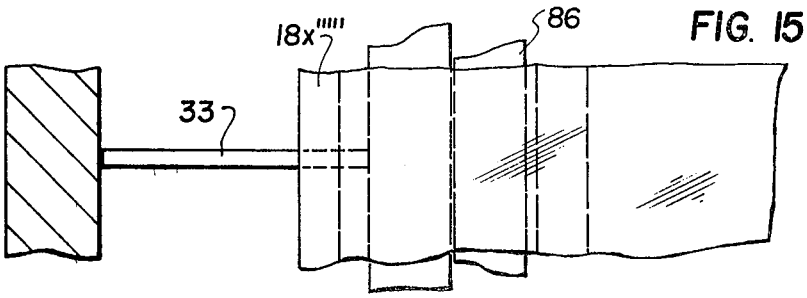
FIG. 15 is a top view of the construction shown in FIG. 13.

In the embodiment of the invention shown in FIGS. 13 to 15, a check valve, generally designated 86, is incorporated into an edge **18*x*''''', which is similar to that shown in the embodiment of FIG. 12. Valve 86 includes an upper portion 86*u* which extends horizontally into a horizontally elongated groove 88*a* defined in the edge 18*x*''''', and a lower portion 86*l* which may extend either along an edge 88 of the sharp corner 18*x*'''''**, as shown in FIG. 13, or downwardly against the exhaust pipe 14, in accordance with the pressure conditions in the system.

In FIG. 13, the lower portion 86*l* is held upwardly along the edge 88 by the flow in the direction of the arrow 90. In the event that there is a back pressure acting on the system in the passage 25′, the valve passage will be closed by the lower flap 86*l* which will drop down due to the pressure changes and will prevent the further discharge of air into the cavity 26. The closed position is shown in FIG. 14, and the open position is shown in FIG. 13.

In FIG. 15, a restraint post is shown which may be oriented to prevent a further deflection of the lower portion 86*l* upon the sudden buildup of pressure. The check valve 86 is made of an elastic material, such as a silicone rubber, which will stay elastic and not crack under conditions of low temperature and cyclic fatigue. In the open position shown in FIG. 13, the valve is slightly pretensioned so that under conditions of either no flow or normally low flows through the muffler, it would be in the closed position shown in FIG. 14.

The length of the valve s would be such that it could prevent the valve from being swallowed into the region of low pressure which is shown in the constricted passage 25′ at the location 85. This would only occur when a backflow is created due to an unwanted low pressure or an oscillatory pressure, such as when a pneumatic tool is spinning down during a shutoff condition. The pre-tension would be sufficient to preclude the abnormal opening of the valve during the observed oscillatory pressure surges during the final stages of shutoff or spindown. The pre-tension should not be too excessive so that the valve will remain completely open, as shown in FIG. 13, during powered operation with a forward flow.

A number of thin posts 33 spaced around the periphery of the valve 34 are used to press against the valve from the upstream side. Such a constraint prevents the valve from being dislodged by back pressure. Optionally, a ring can be used for such a purpose. Alternately, the valve can be restrained in other similar ways with the net result being to prevent its dislodging. Should injection molding be used as the mode of manufacture, this constraining structure should be able to be withdrawn from the mold.

As shown in FIGS. 16 and 17, means are provided for regulating the gap t, which include spacer pegs 96 which are advantageously threadable into either wall 32*e*′′′′′ or sleeve 18′′′′′, or both. Rotation in one direction would facilitate the widening of the gap t and, in an opposite direction, the shortening of such a gap. Of course, the "O" ring 37 would have to be dimensioned to accommodate any shifting of the tubular member 18′′′′′.

While specific embodiments of the invention have been shown and described in detail to illustrate the application of the principles of the invention, it will be understood that the invention may be embodied otherwise without departing from such principles.

What is claimed is:

1. A muffler construction, particularly for exhaust gases of air-operated tools, comprising, a tubular sleeve having a passage therethrough, exhaust gas pipe means extending into said sleeve and defining a constricted flow passage with said sleeve, a shell having first and second opposed cylindrical coaxial shell sections, each having an end wall at their respective outer ends and facing in opposite directions engaged with said exhaust gas pipe means, and side walls spaced radially outwardly from said sleeve, said exhaust gas pipe means having a gas pipe discharge, partition means in said shell section defining a first expansion chamber and at least one additional expansion chamber, said constricted flow passage extending between said first expansion chamber and said at least one additional expansion chamber, sealing and enclosing means closing said sidewalls of said first and second shell sections so as to define the first expansion chamber and at least one additional expansion chamber within said shell sections, the exhaust gases from said discharge entering into said first expansion chamber and forming a vortex therein with the gases then flowing into said constricted passage into said one additional expansion chamber to form an additional vortex, and a final gas discharge defined in said wall of said second shell section communicating with said additional expansion chamber.

2. A muffler, as claimed in claim 1, wherein said partition means includes a radial wall extending radially outwardly from said tubular sleeve intermediate the length thereof, said sealing and enclosing means including a male coupling part on said first shell section, a female part on said second shell section receiving said male part with the interposition of the end of said partition wall therebetween, and sealing means in said coupling between said male part and said partition wall.

3. A muffler, as claimed in claim 1, wherein said tubular sleeve includes a radially extending wall portion extending to the juncture of said first and second shell sections and defining a respective first chamber on one side thereof and at least one additional chamber on the other side thereof, said exhaust gas pipe means including a tubular pipe having an exhaust gas discharge being located with a portion thereof within said tubular sleeve and spaced therefrom to define said constricted passage, said sleeve member being spaced from the end wall of said first shell section to define a flow passage for the exhaust gases into said first expansion chamber.

4. A muffler, as claimed in claim 3, wherein said exhaust pipe includes a wide diameter portion spaced from said tubular sleeve forming said constricted passage and a smaller diameter portion forming a widened section of said constricted passage, said final discharge including a plurality of ports overlying said wider diameter portion of said constricted passage.

5. A muffler, as claimed in claim 1, wherein said tubular sleeve includes at least two separate sleeve parts, a plurality of spaced radially extending partition walls defined along the length of said parts and extending outwardly into engagement with said sidewalls of said cylindrical shell sections, including an intermediate section arranged between intermediate ones of said partition walls with said first and second opposed cylindrical coaxial shell sections being arranged at respective ends and between said intermediate cylindrical sections, and including an opening defined between said sleeve parts into each of the intermediate sections for the inflow of the exhaust gases thereto to form flow paths.

6. A muffler, as claimed in claim 1, wherein said partition means comprises first and second radially spaced tubular sleeve members, said members spaced apart radially to define said constricted passage therebetween, said first expansion chamber being defined between said first tubular sleeve member and said exhaust gas pipe means and said at least one additional chamber being defined between said second tubular sleeve member and said side walls of said tubular sleeves.

7. A muffler, as claimed in claim 6, wherein one of said first and second tubular sleeve members extends to one of said end walls, and including a plurality of circumferentially spaced openings defined around the periphery of an edge of said one of said first and second tubular sleeve member adjacent said one of said end walls.

8. A muffler, as claimed in claim 6, wherein said second tubular sleeve member is spaced from the opposite end wall of said second shell section to define a flow passage from said constricted passage to said at least one additional chamber.

9. A muffler, as claimed in claim 6, wherein said partition means comprises a first tubular sleeve member secured to said second shell section and extending partially to said first shell section and a sleeve member disposed intermediate said first and second shell sections and having a partition wall interengaged between the sidewalls of said shell sections.

10. A muffler, as claimed in claim 1, wherein said exhaust gas pipe means comprises a pipe arranged eccentrically within said first and second cylindrical shell sections.

11. A muffler, as claimed in claim 1, including a wall defining a chamber between said constricted passage and said final discharge, and opening from said constricted passage into said chamber, and valve means for controlling the opening and closing of said opening.

12. A muffler, as claimed in claim 11, wherein said valve means comprises first and second spaced apart pivot members, a hinge plate pivoted on said pivot members, and means for biasing said hinge plate against said wall to close said opening.

13. A muffler device, having an external casing for discharging exhaust gases, such as, the exhaust gases of air-operated tools, having an external casing formed with at least one air exhaust port, said muffler comprising, in combination, at least two substantially cylindrical outer shell sections arranged in axially abutting coaxial relation with each other and adapted to be mounted in radially spaced coaxial surrounding relation with the external casing of an air-operated tool, the two terminal outer shell sections each having a radially inwardly extending annular end wall engageable with such external casing, whereby, the outer shell sections, when mounted on the external casing of an air-operated tool define, with such external casing, an annular chamber in communication with the at least one air exhaust port of the external casing and closed except for said air discharge port means, at least one outer shell section being formed with air discharge port means, at least one sleeved baffle supported by said shell sections within said annular chamber, said sleeved baffle including a tubular sleeve, adapted to surround such external casing in radially spaced relation therewith, and an annular baffle projecting radially from said tubular sleeve intermediate its ends and having its radially outer periphery engaged between adjacent ends of two shell sections to subdivide said annular chamber, said sleeve defining, with such external casing, an air flow constriction annular passage acoustically coupling the subdivisions of said annular chamber and providing for air flow between said subdivisions, said sleeve extending into a terminal shell section defining, with the end wall thereof, an opening into the associated subdivision of said annular chamber.

14. A muffler, as claimed in claim 1, wherein said partition means includes an axially extending wall spaced inwardly from each cylindrical shell section end wall and defining a gap therebetween, for the flow of exhaust gases from an associated chamber to an associated chamber in respect to said constricted passage.

15. A muffler, as claimed in claim 1, including gap adjusting means for adjusting a gap between said sleeve and at least one of said cylindrical shell end walls.

16. A muffler, as claimed in claim 15, wherein said adjusting means comprises a threadable member extending between said sleeve and the associated cylindrical shell sidewall.

17. A muffler, as claimed in claim 15, wherein said sleeve, adjacent at least one of said shell end walls, which is adjacent said gas pipe discharge, has a sharpened edge terminating in a point on its side facing said first expansion chamber.

18. A muffler, as claimed in claim 15, wherein said sleeve adjacent the cylindrical shell end opposite to said exhaust gas pipe discharge has an edge which is rounded on its underside and squared off at its top which faces said additional expansion chamber.

19. A muffler, as claimed in claim 1, including valve means located between said gas pipe discharge and said final discharge.

20. A muffler, as claimed in claim 19, wherein said valve means includes a valve member carried on said tubular sleeve between said tubular sleeve and said exhaust gas pipe means and having a first portion held by said wall and a second portion of a resilient material extending downwardly against said exhaust gas pipe means when the pressures between said first expansion chamber and said constricted gas passage are substantially the same, but being forced upwardly to permit flow through said constricted gas passage when the gas flow is such that the pressure from said gas pipe into said constricted gas passage and said first expansion chamber is large enough to force said valve portion upwardly against said axially extending wall portion of said tubular sleeve.

21. A muffler, as claimed in claim 20, wherein said tubular sleeve includes an edge adjacent said first cylindrical end wall and defining a gap with said end wall into said first expansion chamber which is sharpened to a point, and a valve member in said edge, including a first portion held by said edge and a second portion depending therefrom, into engagement with said gas pipe means, but being deflectable by gas flow upwardly to permit flow from said first expansion chamber through said constricted gas passage.

22. A pressure gas operated device, comprising an exhaust conduit for said pressure gas to which the pressure gas flows, means defining at least one substantially annular pressure gas treatment chamber adjacent said exhaust conduit, said treatment chamber having an interior wall bounding said chamber shaped to provide an ordered substantially annular whirling vortex flow to the pressure gas, an air inlet passage part connected to said chamber and defining a constricted flow path for said pressure gas and located to direct the gas against said bounding wall and to effect a wall attachment of the gas so as to begin its formation into a whirling vortex flow, and discharge passage means connected to said treatment chamber defining a gas passage for the controlled flow of the pressure gas to the atmosphere without disturbing the whirling vortex flow.

* * * * *